United States Patent [19]

Whitney et al.

[11] Patent Number: 4,849,611

[45] Date of Patent: Jul. 18, 1989

[54] SELF-REGULATING HEATER EMPLOYING REACTIVE COMPONENTS

[75] Inventors: Wells Whitney, Menlo Park; Brian Kennedy; Chester Sandberg, both of Palo Alto, all of Calif.

[73] Assignee: Raychem Corporation, Menlo Park, Calif.

[21] Appl. No.: 810,134

[22] Filed: Dec. 16, 1985

[51] Int. Cl.[4] ..... H05B 3/02

[52] U.S. Cl. ..... 219/538; 219/482; 219/505; 219/543; 219/544; 219/545; 219/546; 219/553; 219/457; 338/308; 338/309

[58] Field of Search ..... 219/482, 505, 538, 543, 219/544, 545, 546, 457, 553; 338/308, 309; 427/49, 58, 96; 430/311

[56] References Cited

U.S. PATENT DOCUMENTS

| | | | |
|---|---|---|---|
| 2,915,615 | 9/1957 | Leipold et al. | 219/46 |
| 3,218,384 | 11/1965 | Shaw | 174/40 R |
| 3,296,364 | 1/1967 | Mason | 174/106 R |
| 3,861,029 | 1/1975 | Smith-Johannsen et al. | 29/611 |
| 4,041,276 | 9/1977 | Schwarz et al. | 219/308 |
| 4,072,848 | 2/1978 | Johnson et al. | 219/528 |
| 4,117,312 | 9/1978 | Johnson et al. | 219/548 |
| 4,271,350 | 6/1981 | Crowley | 219/549 |
| 4,309,597 | 1/1982 | Crowley | 219/549 |
| 4,314,145 | 2/1982 | Horsma | 219/553 |
| 4,582,983 | 4/1986 | Midgley et al. | 219/539 |
| 4,629,869 | 12/1986 | Bronnuall | 219/553 |

FOREIGN PATENT DOCUMENTS

| | | | |
|---|---|---|---|
| 289262 | 4/1971 | Austria | 219/535 |
| 038718 | 10/1981 | European Pat. Off. . | |
| 065779 | 1/1982 | European Pat. Off. | 219/548 |
| 092406 | 10/1983 | European Pat. Off. | 219/548 |
| 175453 | 3/1986 | European Pat. Off. | 219/548 |
| 2206642 | 7/1974 | France | 219/552 |
| 82/03305 | 9/1982 | PCT Int'l Appl. . | |
| 84/02098 | 6/1984 | PCT Int'l Appl. . | |
| 84/04698 | 12/1984 | PCT Int'l Appl. . | |
| 2148677 | 5/1985 | United Kingdom . | |
| 2148679 | 5/1985 | United Kingdom . | |

*Primary Examiner*—E. A. Goldberg
*Assistant Examiner*—Gerald E. Preston
*Attorney, Agent, or Firm*—Timothy H. P. Richardson; Herbert G. Burkard

[57] ABSTRACT

Novel electrical heater which are self-regulating as a result of appropriate combination of a constant current or constant voltage power source with a resistive heating component and a temperature-sensitive component. Preferred heaters comprise a plurality of heating units, each of which heating units comprises a reactive component, a resistive heating component, and a temperature-responsive component. Self-regulation of the heater may be achieved in a number of different ways, including the use of employing a reactive component and a temperature-responsive component which form a combination exhibiting an impedance which changes with temperature. The temperature-responsive component can for example change in dielectric constant, or in permeability or in shape, or can effect changes in the frequencies inputted to the reactive component.

23 Claims, 11 Drawing Sheets

SELF-REGULATING HEATER EMPLOYING REACTIVE COMPONENTS

FIELD OF THE INVENTION

This invention relates to self-regulating electrical heaters.

INTRODUCTION TO THE INVENTION

Many elongate electrical heaters, e.g. for heating pipes, tanks and other apparatus in the chemical process industry, comprise two (or more) relatively low resistance conductors which are connected to the power source and run the length of the heater, with a plurality of heating elements connected in parallel with each other between the conductors (also referred to in the art as electrodes.) In conventional conductive polymer strip heaters, the heating elements are in the form of a continuous strip of conductive polymer in which the conductors are embedded. In other conventional heaters, known as zone heaters, the heating elements are one or more resistive metallic heating wires. In zone heaters, the heating wires are wrapped around the conductors, which are insulated except at spaced-apart points where they are connected to the heating wires. The heating wires contact the conductors alternately and make multiple wraps around the conductors between the connection points. For many uses, elongate heaters are preferably self-regulating. This is achieved, in conventional conductive polymer heaters, by using a continuous strip of conductive polymer which exhibits PTC behavior. It has also been proposed to make zone heaters self-regulating by connecting the heating wire(s) to one or both of the conductors through a connecting element composed of a ceramic PTC material. It has also been proposed to make heaters in which self-regulation is achieved through particular combinations of a constant current power supply with a resistive heating element and a temperature-sensitive inductive element. Documents which disclose elongate and/or self-regulating heaters include U.S. Pat. Nos. 3,218,384, 3,296,364, 3,861,029, 4,072,848, 4,117,312, 4,271,350, and 4,309,597, and Published PCT Patent Applications Nos. 82/03305, 84/02098 and 84/04698, corresponding to U.S. Ser. Nos. 243,777, 445,819 and 498,328. The disclosure of each of these documents is incorporated herein by reference.

Documents describing conductive polymer compositions and devices comprising them include U.S. Pat. Nos. 3,861,029 and 4,072,848, the disclosures of which are incorporated herein by reference.

SUMMARY OF THE INVENTION

We have now discovered improved self-regulating heaters which can be powered by a constant current or constant voltage power source and which comprise a reactive component, a resistive heating component an a temperature-responsive component which has an electrical property which varies with temperature so that, when the heater is connected to a suitable power supply, the heat generated by the heating unit decreases substantially as the temperature of the unit approaches an elevated temperature. Any two, or all three, of the reactive, resistive and heat-responsive components can be provided by the same component or by components which are in direct physical and electrical contact with each other. Where components are electrically separate from each other, i.e. are electrically joined by means of discrete electrical connectors, they can be separated by air or another fluid dielectric and/or by solid insulation which is directly contacted by each component, so as to provide a desired degree of thermal coupling and/or physical strength. In one class of preferred heaters, the temperature-sensitive component is not in direct physical contact with the resistive component, and preferably is separated therefrom by insulation (which may be solid and/or gaseous) such that, when the heater is used to heat a substrate, the temperature of the temperature-responsive component is primarily dependent on the temperature of the substrate, rather than the temperature of the heating component. This is an important advantage over prior art self-regulating heaters.

Many of the heaters of this invention contain a plurality of discrete heating units. The heating units in a particular heater are preferably identical to each other, for ease of manufacture and uniformity along the length of the heater; however, heating units of two, three or more different kinds can be used in the same heater. The term "plurality" is used in a broad sense to mean two or more, but in most cases the elongate heater will comprise a larger number of units, for example at least 10, preferably at least 100, with much larger numbers of 1,000 or more being appropriate when the heater is an elongate heater which is wrapped around an elongate substrate, e.g. a pipe or which is coiled to heat an area of a substrate, e.g. the base of a tank, or under a helicopter landing pad.

The AC power supplies used to power the heaters of the invention can be constant voltage or constant current power supplies, and their frequencies should be correlated with the reactive component to provide desired properties in the heater. In some cases, the reactive component and a constant voltage power supply together ensure that the current through the resistive component cannot exceed a particular value, or regulate the current through the resistive component in some other way. Although these power supplies are referred to herein as constant voltage and constant current power supplies, the heaters of the invention will have satisfactory practical performance even if the power supplies deviates quite substantially from its nominal "fixed" value. This is of little practical significance in the case of constant voltage power supplies, which are widely and cheaply available. It is, however, of importance in the case of constant current power supplies, because it means that the invention can make use of "rough" constant current power supplies, which are cheaper to manufacture and are more rugged than many known constant current power supplies.

In a first aspect of the present invention, the electrical heater comprises:

(A) two connection means which are connectable to an AC power supply; and (B) a plurality of discrete, spaced-apart heating units, each of said heater units comprising (a) a reactive component;

(b) a resistive heating component which generates heat when the connection means are connected to a suitable AC power supply; and (c) a temperature-responsive component which has an electrical property which varies with temperature so that, when the heater is connected to a suitable AC power supply, the heat generated by the heating unit decreases substantially as the temperature of the unit approaches an elevated temperature.

Preferably, the heater is an elongate heater, for example, at least 2 meters in length, particularly 15 meters in length, e.g. 50 meters or more.

In a second aspect, the present invention provides a heating circuit which comprises, and may consist essentially of, (A) an AC power supply, and (B) a heating unit which comprises (a) a reactive component;

(b) a resistive heating component which is connected to the reactive component by discrete electrical conductors; and (c) a temperature-responsive component which is not in direct physical contact with the heating component and which has an electrical property which varies with temperature so that the heat generated by the heating unit decreases substantially as the temperature of the unit approaches an elevated temperature.

Preferably, the reactive component is an inductor whose impedance decreases with temperature, the resistive component is connected in parallel with the reactive component, and the power supply is a constant current source.

In a third aspect, the invention provides a self-regulating electrical heater, the heater comprising:

(A) two connection means which are connectable to a power supply; and (B) a plurality of discrete, spaced-apart heating units, each of said heater units comprising (a) an active circuit component;

(b) a resistive heating component which generates heat when the connection means are connected to a suitable power supply; and (c) a temperature-responsive component which has an electrical property which varies with temperature so that, when the heater is connected to a suitable power supply, the heat generated by the heating unit decreases substantially as the temperature of the unit approaches an elevated temperature.

We have further discovered that very useful self-regulating heaters can be made by connecting a constant current power supply, e.g. a "rough" constant current power supply as referred to above, to a resistive heating component which has a negative temperature coefficient of resistance (NTCR).

We have further discovered that very useful heaters can be made by connecting a constant current power supply to a resistive heating component which has a zero temperature coefficient of resistance (ZTCR), in which case the heat output per unit area of the heater is independent of the size of the heater thus making it possible, for example, to make a heater of any desired length simply by cutting a desired, discrete length from a substantially longer elongate series heater, e.g. a mineral insulated cable heater, and connecting the cut ends of the heating element together.

We have further discovered that very useful heaters can be made by connecting a constant voltage power supply to a heater which comprises:

(A) two elongate connection means which are connectable to the constant current power supply; and (B) a plurality of discrete, spaced-apart heating units which are electrically connected in parallel with each other between the connection means and each of which comprises:

(a) a first resistive heating component having a positive temperature coefficient of resistance; and (b) a second resistive heating component having a zero temperature coefficient of resistance and connected in parallel with the first resistive heating component.

In the heating circuits which employ a constant current power source, it is desirable that the circuit should comprise means for detecting an arcing fault, and/or means for detecting an open circuit, and/or means for detecting a short within the heater, and/or means for detecting a ground fault. Such means can be part of the constant current power source. Such means can comprise, for example, a ground fault detector or a frequency spectrum analyser, both of which can detect an arcing fault. A particularly useful example of such a means is a means for detecting when the voltage of the power source falls outside a predetermined range which is set by the normal operating characteristics of the heater. If the voltage drops below that range, this indicates that there may be an arcing fault, or a short within the heater, or a ground fault. If the voltage rises above that range, this indicates that there may be an open circuit fault.

The heaters and heating circuits can be used to heat a wide variety of substrates, but in many cases the substrate is a container of some kind for a liquid, and the objective is to heat the liquid.

BRIEF DESCRIPTION OF THE DRAWING

The invention is illustrated in the accompanying drawing in which.

DETAILED DESCRIPTION OF THE INVENTION

Figure 1:
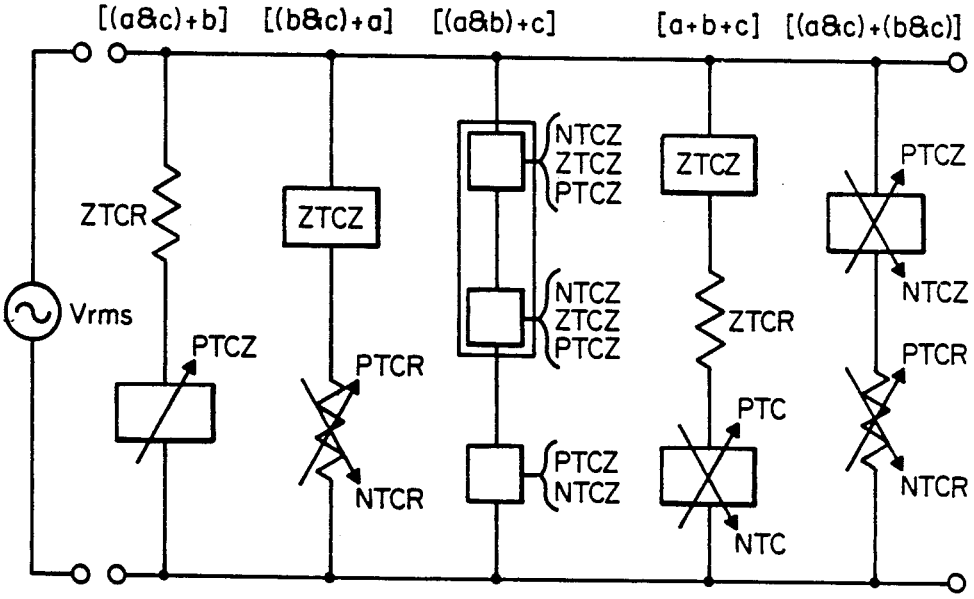
FIGS. 1 to 8, and 13 to 18 provide illustrative circuit diagrams of the invention.

The terms ZTCZ and ZTCR are used herein as abbreviations for, respectively, a zero temperature coefficient of impedance and zero temperature coefficient of resistance. The term zero temperature coefficient means that the property in question (i.e. impedance or resistance) at 0° C. is 0.5 to 2 times, preferably 0.9 to 11 times the same property at all temperatures in the operating range of the heater, e.g. 0° to 300° C.

The terms NTCZ and NTCR are used herein as abbreviations for, respectively, a negative temperature coefficient of impedance and negative temperature coefficient of resistance. The term negative temperature coefficient means that the property in question (i.e. impedance or resistance) at 0° C. is at least 2 times preferably at least 5 times the same property at a temperature in the operating range of the heater, e.g. 0° to 300° C.

The terms PTCZ and PTCR are used herein as abbreviations for, respectively, a positive temperature coefficient of impedance and positive temperature coefficient of resistance. The term positive temperature coefficient means that the property in question (i.e. impedance or resistance) at 0° C. is less than 0.5 times, preferably less than 0.2 times, the same property at a temperature in the operating range of the heater, e.g. 0° to 300° C.

In each of the above definitions, the impedance Z is complex impedance, its real part being resistance and its imaginary part being inductive reactance and/or capacitative Heaters of the invention can be made by appropriate combination of the specified components, in particular by (1) employing a reactive component (a) that may have a PTCZ or NTCZ or ZTCZ characteristic;
(2) employing a heating component (b) that may have a PTCZ or NTCZ or ZTCZ characteristic;
(3) employing a temperature-responsive component (c) that may have a PTCZ or NTCZ or ZTCZ characteristic;
(4) providing such a temperature-responsive component (c) that can make use of
  (i) controlled changes in the shape and configuration of the reactance component (a);
  (ii) controlled changes in the magnetic and/or dielectric properties of the reactance component (a); and/or
  (iii) controlled changes in the frequencies inputted to the reactance component (a);
(5) providing a heater unit wherein the reactive component (a) and the temperature-responsive component (c) are physically combined in one device that is separate from the heating component (b) i.e., a heater unit that may be referenced as (a&c)+b;
(6) providing a heater unit wherein the heating component (b) and the temperature-responsive component (c) are physically combined in one device that is separate from the reactive component (a) i.e., a heater unit that may be referenced as (b&c)+a;
(7) providing a heater unit wherein the reactive component (a) and the heating component (b) are physically combined in one device that is separate from the temperature-responsive component (c) i.e., a heater unit that may be referenced as (a&b)+c;
(8) providing a heater unit comprising an (a&c)+(b&c);
(9) connecting the components a, b and c in series and/or parallel;
(10) connecting the two connection means to a constant current power supply; and/or
(11) connecting the two elongate connection means to a constant voltage power supply.

A number of specific embodiments of the invention will now be described.

1. A first preferred set of embodiments of the first aspect of the present invention wherein, in each heating unit, the reactive component (a) and the heating component (b) are physically separate from each other and are connected in series.

In these embodiments, the two connection means are preferably connectable to an AC power supply which is a constant-voltage (rms) alternating power supply, typically operating in a frequency range from 50 hz to $1\times10^6$ hz and from 1 volts to 1500 volts.

The heating unit connected to such a power supply may incorporate one or more of the following five designs (See FIGS. 1 and 2):

(i) (a&c)+b;
(ii) (b&c)+a;
(iii) (a&b)+c;
(iv) a+b+c; or
(v) (a&c)+(b&c).

Number One: a heating unit that includes the (a&c)+b design may include a ZTCR heating component (b) in series with a reactive component (a) that has a PTCZ temperature-responsive characteristic i.e. (a&c). The impedance Z, in the PTCZ component (c), may be provided by a component that is substantially capacitive or inductive. The impedance Z may have a resistive component $R_z$, so long as the ratio of the real to the imaginary component of Z is less than 0.1, or so long as the ratio of $R_z$ to the R of the ZTCR heating component (b) is less than 0.1, over substantially the entire operating range of the heating unit. Preferably, Z is PTC and capacitive (i.e. NTCC) and acts as a current regulator, thus regulating and reducing current inputted to the ZTCR heating component (b), as this component (b) becomes progressively hotter.

A first heating unit that includes such an [(a&c)+b] design may be connected in parallel with other independent heating units [(a&c)+b]'. The primed units are similar to the first heating unit, and may, for example, have a reactive component (a)' that is NTCL or NTCC or PTCC or PTCL, and have an R' magnitude different from R. In other words, the primed units are similar to the unprimed units, but may differ by selecting one of the several possible permutation of components suggested in the preceding paragraph.

Number Two: a heating unit that includes the (b&c)+a design may include a ZTCZ reactive component (a) in series with a PTCR or preferably NTCR heating component (b) i.e. (b&c). The impedance Z (in the ZTCZ reactive component (a)) may be provided by a component that is either substantially capacitive or inductive. The impedance Z may have a resistive component $R_z$, so long as the ratio of the real to the imaginary portion of Z is less than 0.1, or, so long as the ratio of $R_z$ to the R of the heating component is less than 0.1, over substantially the entire operating range of the heating unit. For example, the reactive component (a), when it acts as a current controller, keeps constant the current inputted to NTCR, so that e.g., as R decreases progressively with temperature, in the case of NTCR, the power $P=I^2R$ of the heater decreases correspondingly.

A first heating unit that includes such a [(b&c)+a] design may be connected in parallel with other independent heating units [(b&c)+a]'. The primed units are similar to the first heating unit, and may, for example, have a reactive component (a)' that is ZTCL or ZTCC or ZTCR (and different or the same as the unprimed unit), and an R' that has a magnitude the same as, or different from, R.

Number Three: a heating unit that includes the (a&b)+c design may include a reactive component (a) that may be either NTCZ or ZTCZ or PTCZ, where the impedance Z may be substantially inductive or capacitive. The reactive component (a) is connected in series to a heating component (b) that may be either NTCZ or ZTCZ or PTCZ. Here, the impedance Z is preferably resistive. The combination of (a&b), in turn, is connected in series to a temperature-responsive component (c) which may be PTCZ or NTCZ.

A first heating unit that includes such an [(a&b)+c] design may be connected in parallel with other independent heating units [(a&b)+c]'. The primed units are similar to the first heating unit, but may differ by selecting one of the many permutations of components suggested in the preceding paragraph.

Some of the indicated permutations of components among (a&b)+c include cases where the subgroup (a&b) can itself provide the capability of a temperature-responsive component. This occurs, for example, when (a&b) together are not ZTC (e.g., PTC or NTC). However, the present invention requires that *this* capability of the subgroup (a&b) be substantially less than that of the temperature-responsive component (c).

Number Four: a heating unit that includes the a+b+c design may include a ZTCZ reactive component (a) in series with a ZTCR heating component (b) in series with a PTC or NTC temperature-responsive component (c). In particular, the temperature-responsive component (c) may be PTCZ or NTCZ.

A first heating unit that includes separate components a+b+c connected in series, may, in turn, be connected in parallel to an independent heating unit comprising an a'+b'+c', and the primes may be the same as, or different from, the unprimed components, according to a selection made from the permutations of components suggested in the preceding paragraph.

Number Five: a heating unit that includes the (a&c)+(b&c) design may include a reactive component (a) that is PTCZ or NTCZ (hence (a&c)), in series with a heating component (b) that is PTCR or NTCR (hence (b&c)).

A first heating unit that includes an [(a&c)+(b&c)] may, in turn, be connected in parallel to an independent heating unit [(a&c)+(b&c)]', where the primed unit may be the same as, or different from, the unprimed heating unit, according to a selection made from the permutation of components suggested in the preceding paragraph.

Figure 2:
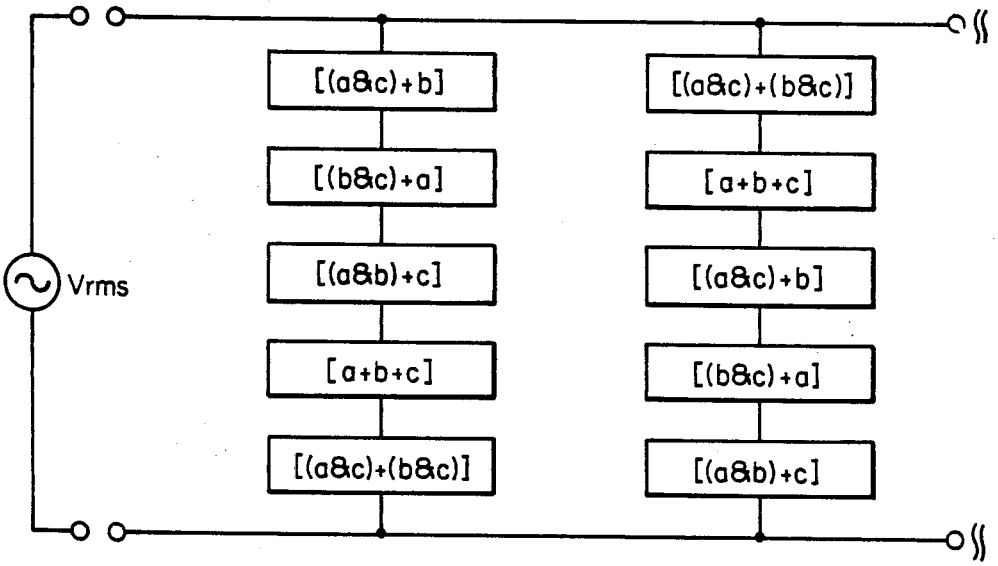

In summary, in the first preferred set of embodiments of the present invention, each heating unit includes the reactive component (a) and the heating component (b) physically separate from each other and connected in series. Each heating unit may include at least one of the previously enumerated five designs. Moreover, the heater may include a plurality of such heating units which are spaced along the length of the heater, each heating unit of which may also include at least one of the previously enumerated five designs. This point is illustrated in FIG. 2. In all cases, the appropriate selection of the components a, b and c will be consistent with the self-regulating characteristic of the heater.

2. A second preferred set of embodiments of the first aspect of the present invention wherein, in each heating unit, the reactive component (a) and the heating component (b) are physically separate from each other and are connected in parallel.

In these embodiments, the two connection means are preferably connectable to an AC power supply which is a constant-current (rms) alternating power supply, typically operating in the frequency range from 50 hz to $\times 10^6$ hz and 1.0 ampheres to 100 ampheres.

Figure 3:
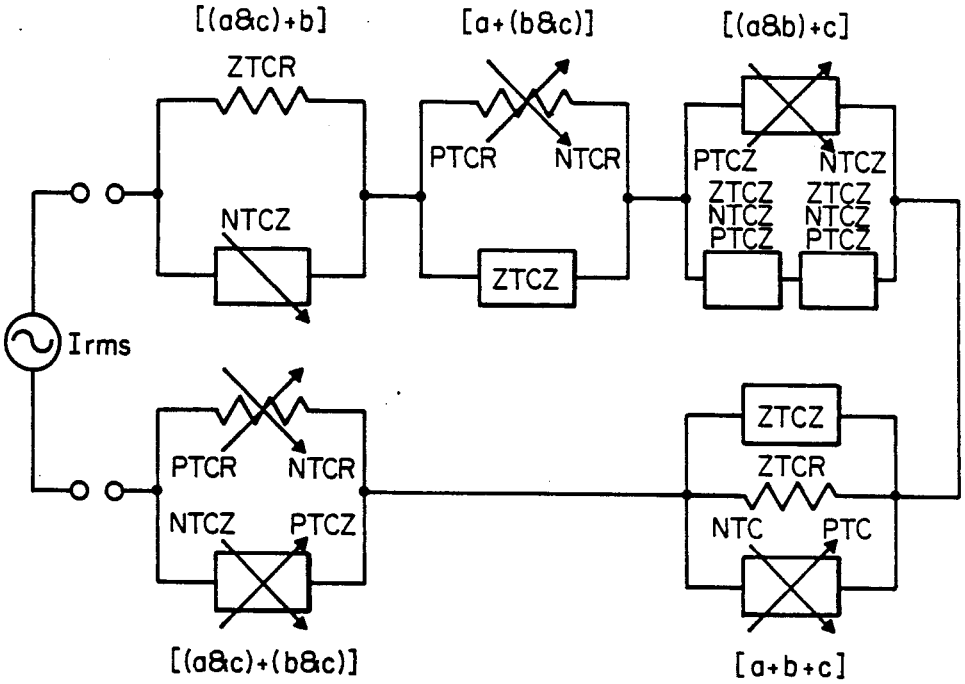

The heating unit connected to such a power supply may incorporate one or more of the following five designs (see FIGS. 3 and 4):

(i) (a&c)+b;
(ii) (b&c)+a;
(iii)(a&b)+c;
(iv) a+b+c; or
(v) (a&c)+(b&c).

Number One: a heating unit that includes the (a&c)+b design may include a ZTCR heating component (b) in parallel with a reactive component (a) that has an NTCZ characteristic i.e. (a&c). The impedance Z [in the NTCZ temperature-responsive component (c)] may be provided by a component (c) that is substantially capacitive or inductive. The impedance Z may, however, have a resistive component $R_z$, so long as the ratio of the real to the imaginary component of Z is less than 0.1, or, so long as the ratio of $R_z$ to the R of the ZTCR heating component (b) is less than 0.1, over substantially the entire operating range of the heating unit. Preferably, the temperature-responsive component (c) is NTC and inductive i.e. NTCL. In operation, this heating unit operates as a choke-shunt so that, at the switching temperature of the NTCL component, the constant current is shunted from the ZTCR heating component (b) to the, now, relatively lower impedance NTCL component, hence effecting self-regulation of the elongate heater.

A first heating unit that includes such an [(a&c)+b] design may, in turn, be connected in series with other independent heating units [(a&c)+b]'. The primed units may be the same as, or different from, the unprimed components, according to a selection made from the permutations of components suggested in the preceding paragraph.

Number Two: a heating unit that includes the a+(b&c) design may include a ZTCZ reactive component (a) in parallel with a PTCR or NTCR heating component (b) i.e. (b&c). The impedance Z (in the reactive component (a)) may be provided by a component that is either substantially capacitive or inductive. The impedance Z may have a resistive component $R_z$, so long as the ratio of the real to the imaginary portion of Z is less than 0.1, or, so long as the ratio of $R_z$ to the R of the PTCR or NTCR heating component (b) is less than 0.1, over substantially the entire operating range of the heating unit.

For example, the reactive component (a), when it acts as a voltage controller, keeps constant the voltage potential across the PTCR heating component, so that as R progressively increases with temperature, the power $V^2/R$ of the heater decreases correspondingly, thus effecting self-regulation. On the other hand, for the case of an NTCR heating component(b), the reactive component (a) acts as a voltage limiter so that at cooler operating temperatures of the heater, it prevents excessive power as R increases with decreasing temperature.

A first heating unit that includes the [a+(b&c)] design may, in turn, be connected in series with other independent heating units [a+(b&c)]'. The primed units may be the same as, or different from, the unprimed components, according to a selection made from the permutations of components suggested in the preceding paragraph.

Number Three: a heating unit that includes the (a&b)+c design may include a reactive component (a) that is either ZTCZ or NTCZ or PTCZ, where the impedance Z may be substantially inductive or capacitive.

The reactive component (a) is connected in series to a heating component (b) that may be NTCZ, PTCZ or ZTCZ. Here, the impedance Z is preferably resistive. The combination of (a&b), in turn, is connected in parallel to a temperature-responsive component (c) which may be PTCZ or NTCZ.

A first heating unit that includes such an [(a&b)+c] design may be connected in series with other independent heating units [(a&b)+c)]'. The primed units are similar to the first heating unit, but may differ by selecting one of the many permutations of components suggested in the preceding paragraph.

Some of the indicated permutations of components among (a&b)+c include cases where the su group (a&b) can itself provide the capability of a temperature-responsive component. This occurs, for example, when (a&b) together are not ZTC (e.g., PTC or NTC). However, the present invention requires that *this* capability of the subgroup (a&b) be substantially less than that of the temperature-responsive component (c).

Number Four: a heating unit that includes the a+b+c design may include a ZTCZ reactive component (a) in parallel with a ZTCR heating component (b) in parallel with a PTC or NTC temperature-responsive component (c). In particular, the temperature-responsive component (c) may be PTCZ or NTCZ.

A first heating unit that includes separate components a+b+c connected in parallel, may, in turn, be connected in series to an independent heating unit comprising an a'+b'+c' and the primes may e the same as, or different from, the unprimed components, according to a selection made from the permutations of components suggested in the preceding paragraph.

Number Five: a heating unit that includes the (a&c)+(b&c) design may include a reactive component (a) that is PTCZ or NTCZ (hence (a&c)), in parallel with a heating component (b) that is PTCR or NTCR (hence (b&c)).

A first heating unit that includes an [(a&c)+(b&c)] may, in turn, be connected in series with an independent heating unit [(a&c)+(b&c)]', where the primed unit may be the same as, or different from, the unprimed heating unit, according to a selection made from the permutation of components suggested in the preceding paragraph.

Figure 4:
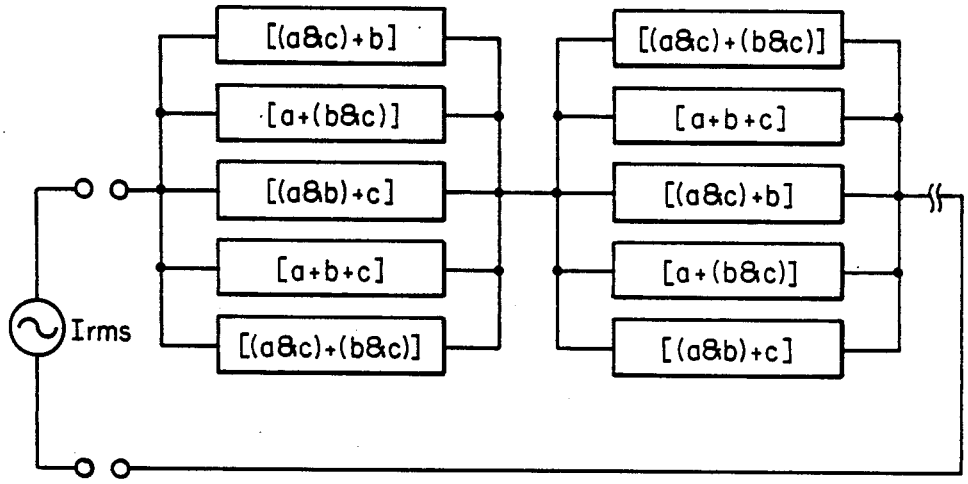

In summary, in the second preferred- set of embodiments of the present invention, each heating unit includes the reactive component (a) and the heating component (b) physically separate from each other and connected in parallel. Each heating unit may include at least one of the previously enumerated five designs. Moreover, the heater may include a plurality of such heating units which are spaced along the length of the heater, each heating unit of which may also include at least one of the previously enumerated five designs. This point is illustrated in FIG. 4. In all cases, the appropriate selection of the components a, b and c will be consistent with the self-regulating characteristic of the heater.

The first and second preferred embodiments of the first aspect of the present invention include, respectively, series and parallel connections of the components a, b and c. The heating unit comprising the components a, b and c may also include series-parallel circuit combinations consistent with the self-regulating characteristic of the heater.

Figure 5A:
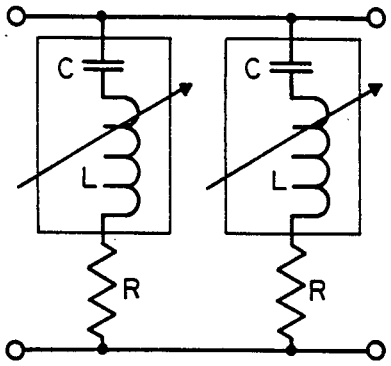
Figure 5B:
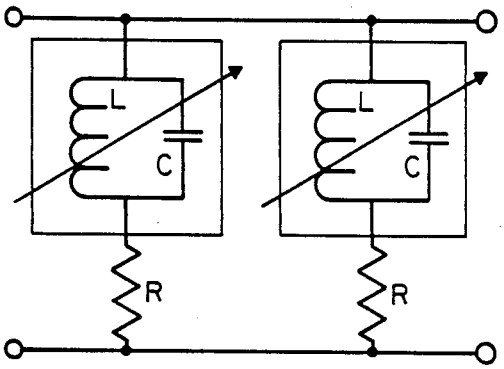
Figure 5C:
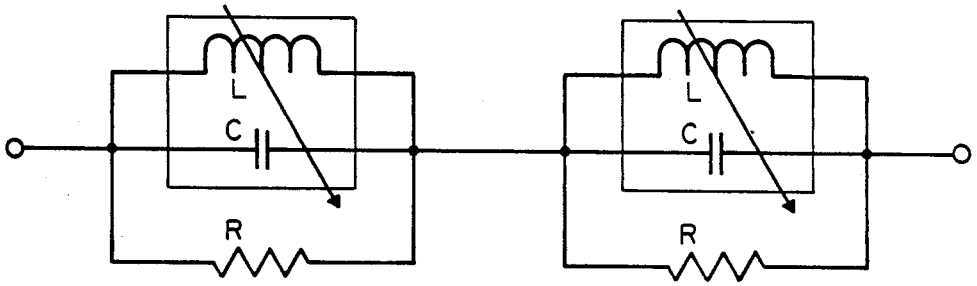
Figure 5D:
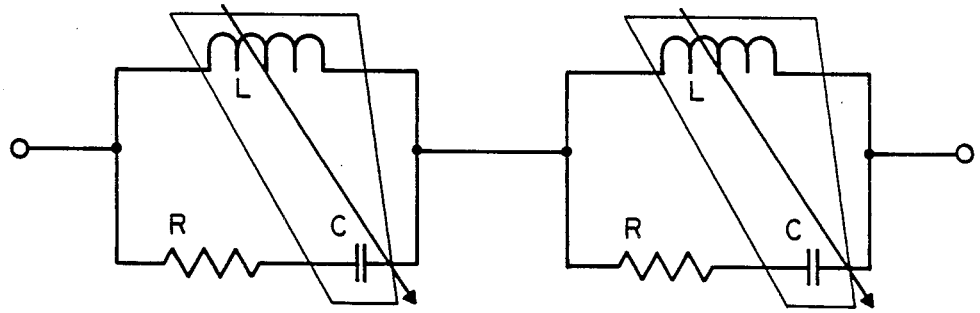

A first example of a series-parallel circuit is shown in FIG. 5*a*. The circuit comprises a ZTCR heating component (b) in series with a reactive component (a) that has a PTCZ temperature-responsive characteristic i.e. (a&c), the series (b)+(a&c) subgroup in turn connected in parallel to a ZTCZ reactive component(a). Preferably, the series-parallel circuit is connected to a constant current power supply. A second example of a series-parallel circuit is shown in FIG. 5*b*. The circuit comprises a ZTCR heating component (b) connected in parallel with a reactive component (a) that has an NTCZ temperature-responsive characteristic i.e. (a&c), the parallel subgroup in turn connected to a ZTCZ temperature-reactive component (a). Preferably, the series-parallel circuit is connected to a constant voltage power supply.

3. Specific, preferred circuits of the first aspect of the present invention.

The two preferred sets of embodiments of the first aspect of the invention emphasize variations in circuit structural arrangements, namely series and/or parallel connections of the components a, b and c.

Attention is now directed to a description of specific, preferred circuits of the first aspect of the invention. These specific circuits include (i) tuned LC circuits; (ii) circuits comprising a ZTC resistor in parallel with the reactive component (a); (iii) circuits comprising first and second reactive components connected in parallel; and (iv) elongate heaters having reactive bus connectors.

(i) Self-regulation by a tuned LC circuit (resonant) or (anti-resonant).

Heretofore, it has been implicitly assumed that a circuit comprised uncoupled inductors and capacitors which regulate the volt-amps dropped across the heating component (b). However, self-regulation may also be advantageously obtained in a coupled or tuned LC circuit, resonant or anti-resonant. In particular, self-regulation is obtained by regulating the amount of volt-amps dropped across the heating component (b), as a circuit moves in and out of resonance or anti-resonance with changing impedance or frequency due to temperature responsive capacitive and/or inductive components.

FIG. 5A, for example, shows a series resonant circuit where L&C are preferably selected so that when a heater is cold, the heater is near resonance and as the heater increases in temperature, the LC circuit moves away from resonance, thus decreasing the current flowing through a heating component and effecting self-regulation.

FIG. 5B shows a parallel resonant circuit, where L&C are preferably selected so that the LC circuit moves towards resonance, thus decreasing the current flowing through a heating component and thus effecting self-regulation.

FIGS. 6C and 6D shows parallel tuned LC circuits for a constant current source, where the tuned circuit is preferably at resonance when a heater is cold and moves out of resonance upon an increase in ambient temperature, thus shunting the current around a heating component and thereby effecting self-regulation.

Figure 7A:
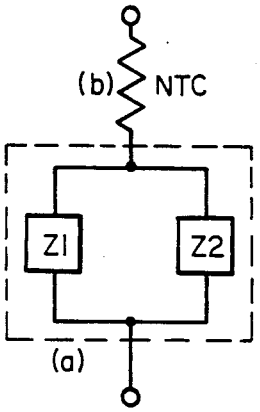
Figure 7B:
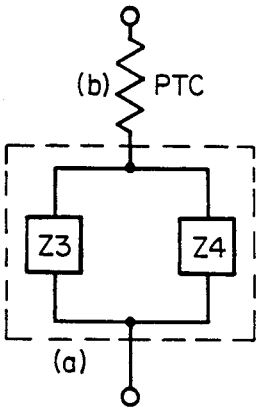

(ii) Circuits Comprising a ZTC Resistor in Parallel With the Reactive Component (a):

In these circuits, the heater preferably comprises a ZTC resistor connected in parallel with a PTCZ or NTCZ reactive element (a), the resistor having a resistance at 0° C. which is at least 0.2 times, preferably at least 0.5 times, especially at least one time, particularly at least five times, its resistance at all temperatures in the operating temperature range of the heater (see FIG. 7).

(iii) Circuits Comprising First and Second Reactive Components Connected in Parallel:

In these circuits, the heater comprises a heating component (b) which is preferably a resistor and which is connected in series with a reactive component (a). The resistor preferably has a resistance at 0° C. which is more than 0.5 times, preferably at least ten times, its resistance at all temperatures in the operating temperature range of the heater (i.e. NTC). The reactive component (a) preferably comprises first and second reactive elements $Z_1$ and $Z_2$ which are of opposite sign (i.e., $Z_1=-Z_2$) and which are connected in parallel. (See FIG. 7A).

Alternatively, the heating component (b) may comprise a PTC resistor which is connected in series with a reactive component (a). Preferably, the resistor has a resistance at 0° C. which is less than 0.2 times preferably less than 0.1 times, its resistance at a temperature in the operating temperature range of the heater. The reactive component (a) preferably comprises first and second reactive elements $Z_3$ and $Z_4$ which are of opposite sign (i.e. $Z_3 = -Z_4$) and which are connected in parallel. (See FIG. 7B).

Figure 8A:
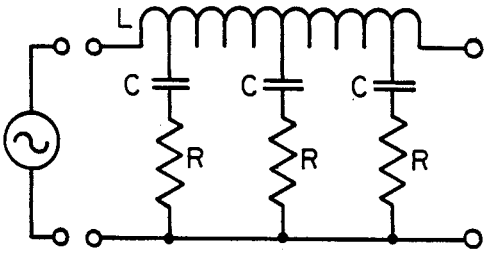
Figure 8B:
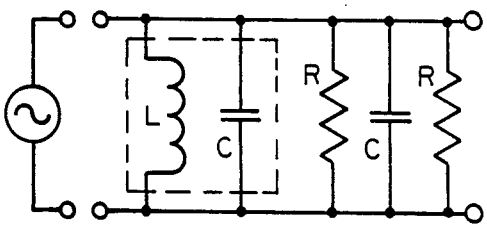

(iv) Elongate Heater Having Reactive Bus Connectors:

The present invention comprises-two connection means which are connectable to an AC power supply. At least one of the connection means may comprise reactive components between adjacent heater units. For example, at least one of the connection means may be a distributed inductor L, as in FIG. 8A. In a preferred embodiment, at least one of the connection means comprises a reactive component, for example one that is substantially capacitive and inductive, as in FIG. 8B, which reactive component, when the heater is connected to a power supply, lies between the power supply and the heating unit nearest the power supply.

4. Details on the components of the Invention in all its aspects.

A. Preferred Resistors and Operating Ranges

The present invention employs resistors which are preferably ZTC, NTC, PTC or voltage dependent, for example a varistor. In particular, a ZTC resistor has a resistance at 0° C. which is preferably from 0.2 to 5 times, particularly 0.5 to 2 times, its resistance at all temperatures in the operating temperature range of the heater e.g. 0° to 300° C. An NTC resistor, on the other hand, has a resistance at 0° C. which is preferably at least 10 times its resistance at a temperature in the operating temperature range of the heater, e.g., 0° to 300° C. The PTC resistor has a resistance at 0° C. which is preferably less than 0.2 times, particularly less than 0.1 times, its resistance at a temperature in the operating temperature range of the heater, e.g., 0° to 300° C.

The resistors employed in the present invention may comprise a film resistor, for example, a thick film resistor, secured to an insulating base. The thick film resistors may be produced by depositing onto the insulating base a dispersion of a particulate ceramic material in a liquid medium, and heating the deposited dispersion.

B. Preferred Reactive Components and Operating Ranges

The present invention includes a reactive component (a) which is preferably ZTCZ, NTCZ or PTCZ. A reactive component (a) that has an NTCZ or PTCZ capability can be achieved through (i) controlled changes in the shape and configuration of the reactive component (a).

(ii) controlled changes in the- magnetic and/or dielectric properties of the reactive component (a); and/or (iii) controlled changes in the frequencies inputted to the reactive component (a).

For example, the self-regulating characteristic of a heater may be provided by combining the reactive component (a) and the temperature-responsive component (c) in the form of a capacitor whose capacitance varies with temperature. This capability may be provided by a capacitor having a dielectric, the dielectric having a physical shape which varies with temperature, or by a capacitor having a dielectric property which changes with temperature. To illustrate the latter point, the capacitor may have a dielectric whose dielectric constant at a first temperature $T_1$, $T_1$ being at least 0° C., is at least 3 times, preferably at least 10 times, the dielectric constant of the dielectric at a second temperature $T_2$ which is between $T_1$ and $(T_1+100)$°C., preferably between $T_1$ and $(T_1+50)$°C. Such a dielectric is preferably a ferroelectric ceramic having a Curie point of at least −25° C., preferably at least 40° C., particularly at least 100° C., especially at least 400° C.

Figure 9:
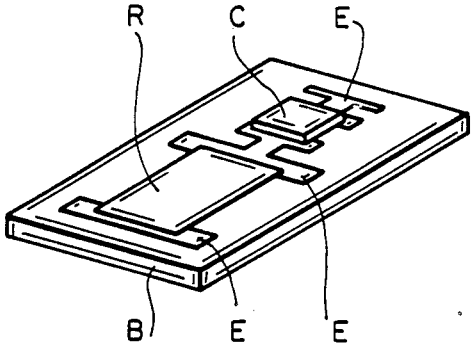
FIGS. 9 to 12, and 19 to 22 are diagrammatic view of heaters of the invention and corresponding circuit diagrams thereof.
Figure 10:
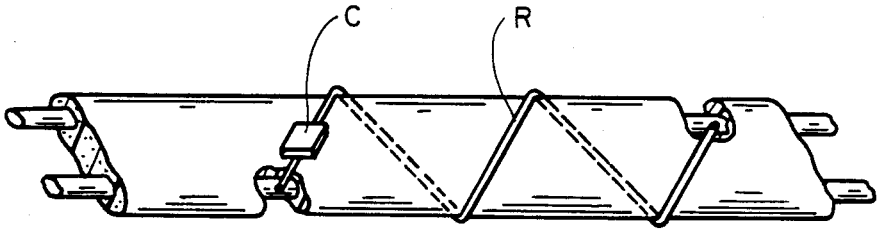
Figure 11:
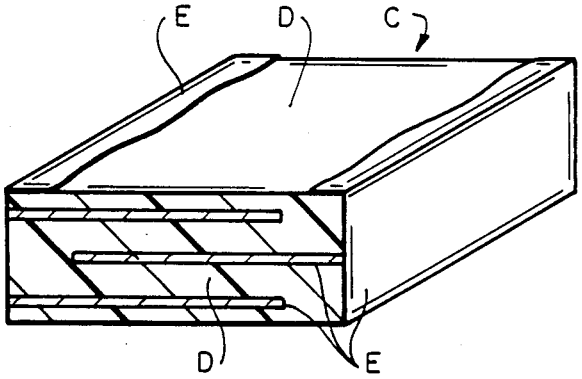

A heater wherein a capacitor has a dielectric whose dielectric constant decreases with temperature may include a heating unit comprising an insulating base B having a resistor R and a capacitor C secured thereto, the resistor R and capacitor C electrically coupled by way of electrodes E. (See FIG. 9). Alternatively, a heating unit may comprise a capacitor C and a resistance heating wire R. (See FIG. 10). Again, alternatively, a heating unit may comprise a capacitor C with dielectric D, and resistive electrodes E which serve as the heating component (b). (See FIG. 11). Or, a heating unit may comprise a heating component (b) and a reactive component (a) combined in the form of a capacitor comprising a lossy dielectric.

Figure 12A:
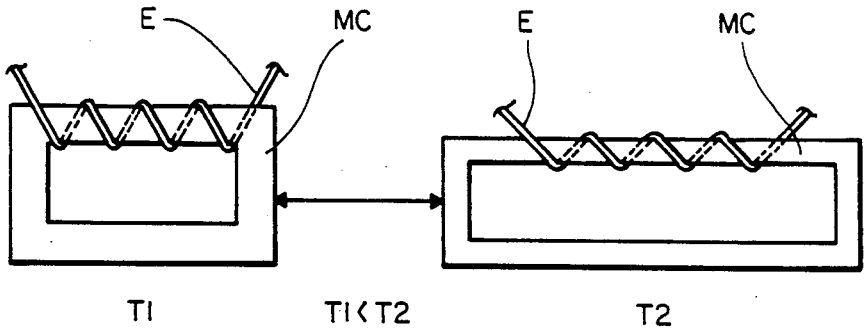
Figure 12B:
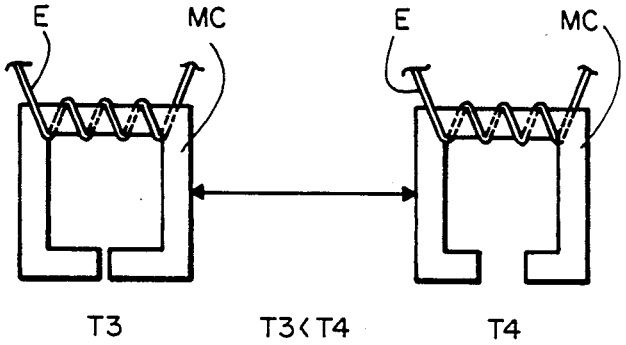
Figure 12C:
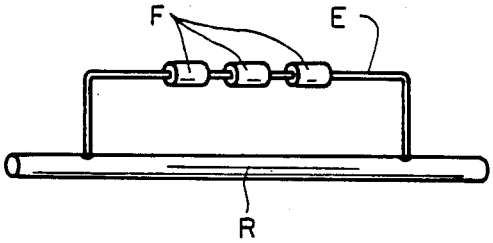

The self-regulating characteristic of the heater may also be provided by combining the reactive component (a) and the temperature-responsive component (c) in the form of an inductor whose inductance varies with temperature. The inductor comprises a magnetic core MC and a low resistive conductive wire E as the winding. This heater may comprise an inductor having a physical shape which varies with temperature, or, by an inductor whose magnetic property changes with temperature. To illustrate the former point, an inductor's shape may change with temperature to increase flux path length or provide increases in the air gap. (See FIGS. 12A and 12B.) To illustrate the latter point, the inductor may have a core whose permeability at a first temperature $T_1$, $T_1$ being at least 0° C., is at least 3 times, preferably 10 times, the permeability of the core at a second temperature $T_2$ which is between $T_1$ and $(T_1+100)$°C., preferably between $T_1$ and $(T_1+50)$°C. Preferably, the inductor is a ferromagnetic ceramic having a curie point of at least −25° C., preferably at least 40° C., particularly at least 100° C., especially at least 400° C. A preferred such heating unit comprises an inductor, which inductor comprises a ferrite bead F slid over a low resistive conductive wire E, the inductor in turn connected to a resistance heating wire R. (See FIG. 12C). In another preferred heating unit, the reactive component (a) and the heating component (b) are physically combined in the form of an inductor comprising a core which is lossy when the heater is connected to a power supply.

The self-regulation of the heater of the present invention may be provided by a temperature-responsive component (c) that is a frequency changing component. For example, when this heater is connected to a suitable power source, the component (c) preferably changes the frequency of the current passing through the reactive component (a). The impedance of the reactive component (a) changes with frequency, and this in turn provides a change in the magnitude of the current flowing and hence in the power dissipated as heat in the resistive heating component (b).

Figure 13A:
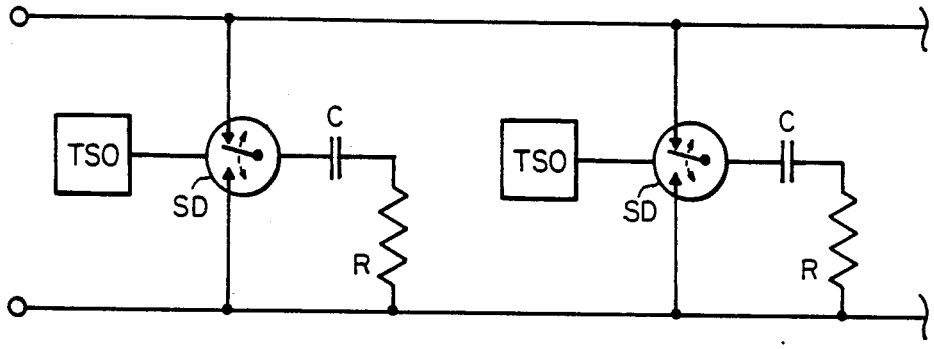
Figure 13B:
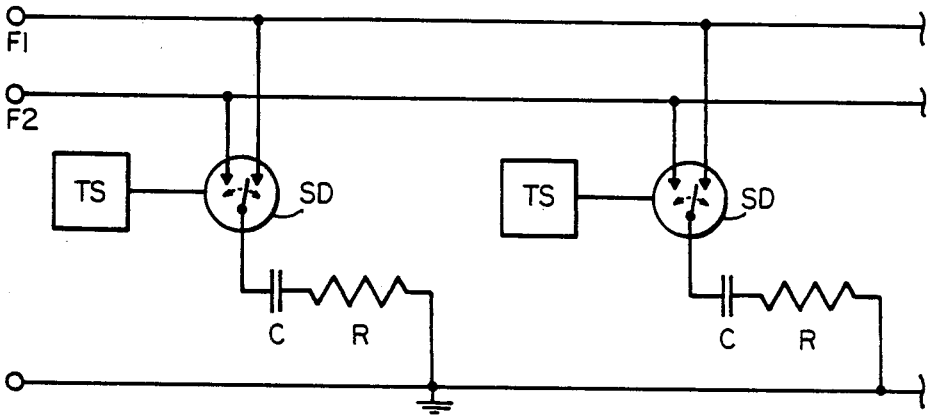

The change in frequency may be provided by a switching device SD such as a transistor or an S.C.R., the switching device in turn controlled by a temperature sensitive oscillator TSO (See FIG. 13A). Or, the switching device may be controlled by a temperature sensor TS to switch a reactive component and its associated heating component (shown as C and R, respectively in FIG. 13B) from one AC supply line to another, at different-frequencies, $f_1$ and $f_2$. Preferably, the frequency change caused by the temperature change is such that the impedance of a reactive component (a) at a first temperature $T_1$, $T_1$ being greater than 0° C., is less than 0.3 times preferably less than 0.1 times, the impedance of the reactive component (a) at a second temperature $T_2$ which is between $T_1$ and $(T_1+100)$°C., preferably between $T_1$ and $(T_1+50)$°C.

5. Details on the Second Through Sixth Aspects of the Invention.

Figure 14A:
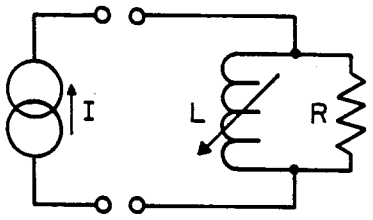
Figure 14B:
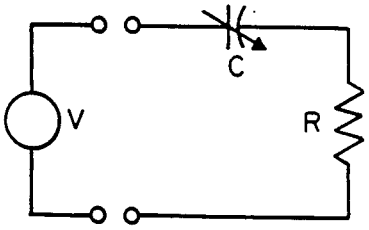

A. As summarized above, the present invention in its second aspect comprises a heating unit, which heating unit comprises a temperature-responsive reactive component and a heating component. The temperature-responsive reactive component and the heating component may be connected in parallel or in series. When connected in parallel, the temperature-responsive reactive component is preferably NTCZ, for example, inductive, and the heater is adapted to be connected to a constant current supply. (See FIG. 14A). On the other hand, when the temperature-responsive reactive component and the heating component are connected in series, the temperature-responsive reactive component is preferably PTCZ, for example, capacitive, and the heater is adapted to be connected to a constant voltage supply. (See FIG. 14B).

Figure 15A:
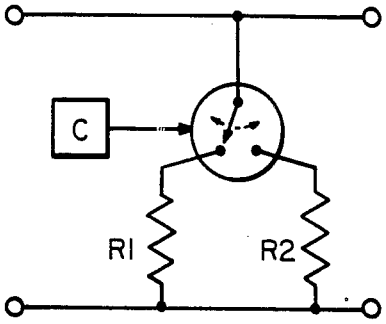
Figure 15B:
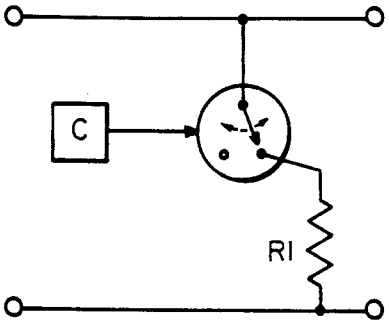

B. As summarized above, the present invention in its third aspect cam employ active devices, e.g., transistorized circuits, which simulate the impedance-temperature characteristics of the passive reactive component (c) described in previously mentioned circuits. Alternatively, an active transistorized device, in response to a temperature-controlled input C, can switch different heating components, of various resistances $R_1$ and $R_2$, in and out of circuits, as in FIG. 15A, or open and close circuits, as in FIG. 15B.

Figure 16:
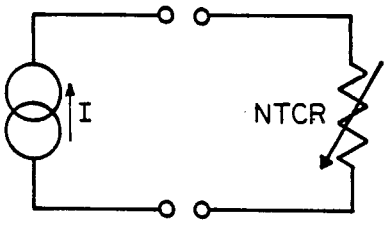

C. As summarized above, the present invention in its fourth aspect comprises an elongate heater, which heater comprises two elongate connection means which are connected to a constant current power supply; and a resistive heating component connected in series with the connection means, the resistive heating component having a substantially negative temperature coefficient of resistance. Preferably, the resistive heating component has a resistance at a first temperature $T_1$, $T_1$ being at least 25° C., at least .3 times, preferably 10 times, its resistance at a second temperature $T_2$ which is at least $(T_1+50)$°C. Preferably, the resistive heating component has a resistivity from $1\times10^{-6}$ ohm cm to 100 ohm cm. The resistive heating component may comprise ceramic or metal. Preferably, at least one of the connection means has a negative temperature coefficient of resistance. The heater may be connected to a constant current power supply having an amperage of at least 0.1 amp RMS. FIG. 16 illustrates this kind of a circuit and shows a NTCR resistive component connected in series with elongate connection means.

Figure 17:
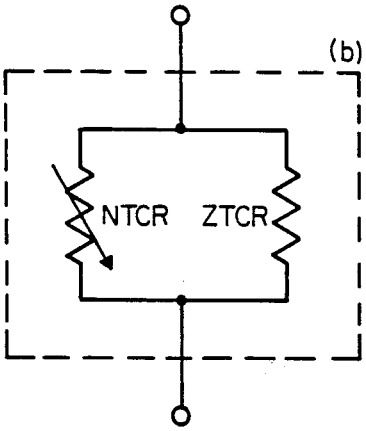

D. As summarized above, the present invention in its fifth aspect comprises an elongate heater, which heater comprises two elongate connection means which ar connected to a constant current power supply; and a resistive heating component connected in series with the connection means, the resistive heating component having a substantially zero temperature coefficient of resistance. Preferably, the resistive heating component has a resistance at 0° C. which is from 0.2 to 5 times, preferably 0.5 to 2 times, its impedance at all temperatures in the operating temperature range of the heater, e.g. 0° to 300° C. The heater may also include an PTCR component connected in series with the ZTCR component. (See FIG. 17) An advantage of this heater is that one can change the length, e.g., the number of heating units that make up the over all heater, without changing the power output per unit length of the heater.

Figure 18:
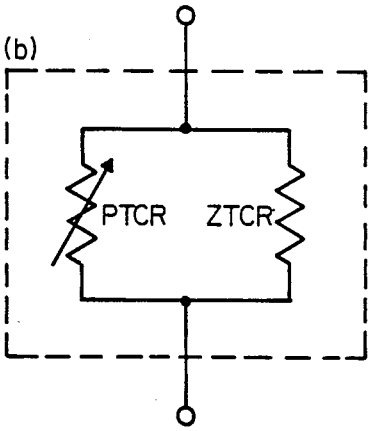

Alternatively, the heating component (b) preferably comprises first and second resistors connected in parallel, the first resistor having a resistance at 0° C. which is more than five times, preferably at least ten times, its resistance at temperature in the operating range of the heater (i.e. NTC), and the second resistor having a resistance at 0° which is from 0.2 to five times, preferably 0.5 to two times, its resistance at all temperatures in the operating temperature range of the heater (i.e. ZTC) (See FIG. 18).

E. As summarized above, the present invention in its sixth aspect comprises an elongate heater, which heater comprises two elongate connection means which are connected to a constant voltage power supply; and a heating unit which is electrically connected to the connection means. Preferably, the heating unit comprises first and second resistors connected in parallel, the first resistor having a resistance at 0° C. which is at least 10 times its resistance at a temperature in the operating range of the heater (i.e. NTC), and, the second resistor having a resistance at 0° C. which is from 0.2 to five times, preferably 0.5 to two times, its resistance at all temperatures in the operating temperature range of the heater (i.e., ZTC) (see FIG. 19B).

EXAMPLE I

Figure 19A:
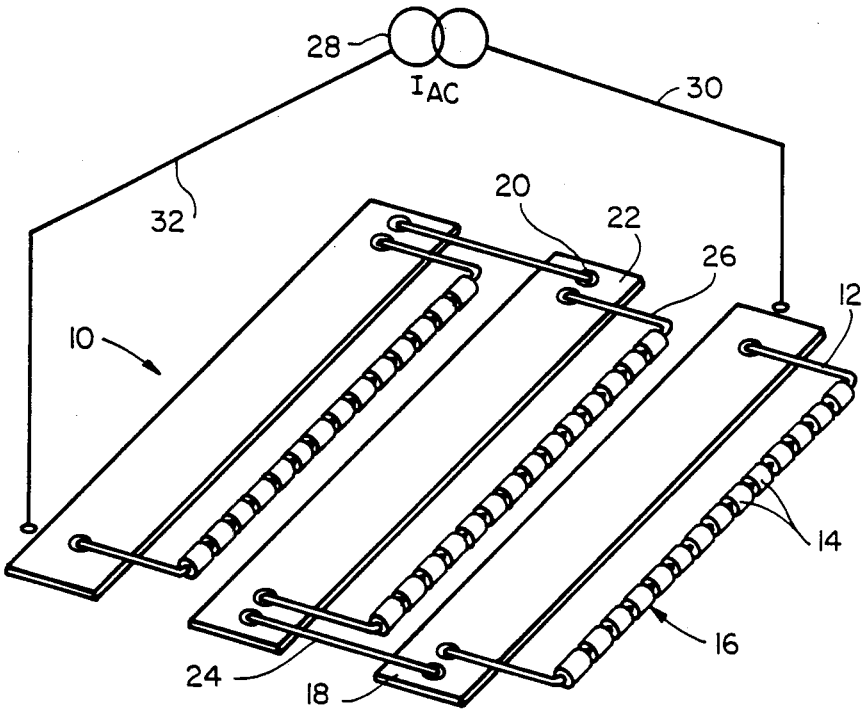
Figure 19B:
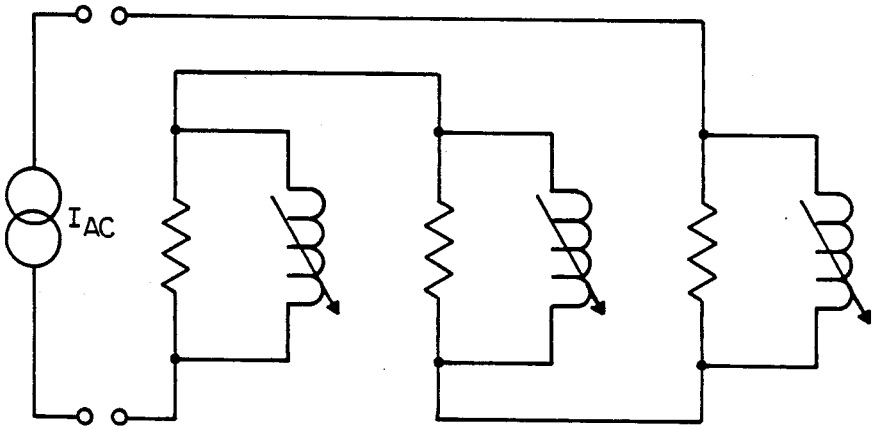

A self-regulating heater (numeral) 10 as illustrated in FIG. 19A and as shown as an electrical circuit in FIG. 19B, was made in the following way. A 10.2 cm 18 AWG nickel-copper alloy wire 12 was provided. Such a wire is available from California Fine Wire, Grover City, Calif., under the product name nickel alloy 30. Twenty-two ferrite beads (each numbered 14) were strung along the nickel-copper alloy wire 12 to produce a beaded nickel-copper alloy wire 16. Such ferrite beads are available from Ferroxcube, a division of Amperex Electronics Corporation, Saugerties, N.Y., part number 5659065-4A6. The ferrite beads 14 each had a length of 0.299 cm, an inner diameter of 0.120 cm, an outer diameter of 0.351 cm, an initial permeability of 1250, a saturation flux density of 3800, a Curie temperature of 150° C. and a DC resistivity at 20° C. of greater than $10^5$ ohm cm. The beaded nickel-copper alloy wire 16 was connected to a resistive ribbon wire 18 by way of a silicon braze 20. Such a braze is available from Englehard Corporation, Plainview, Mass., under the product name SILVALLOY10. The resistive ribbon wire 18 had a 7.62 cm length, a width of 0.635 cm and a resistance of 0.082 ohm/cm. Such a resistive ribbon wire is available from California Fine Wire, Grover City, Calif., under the product name Stable Ohm 650. This unit construction was repeated by connecting the resistive ribbon wire 18 to a second resistive ribbon wire 22, by way of a nickel-copper alloy wire 24 having a length of 3.17 cm. The second resistive ribbon wire 22, in turn, was connected to a second beaded nickel-copper alloy wire 26. The self-regulating heater 10, ultimately constructed, had a length of approximately 7.62 centimeters. The heater 10 was connected to a 15 amp(rms), 20 Khz constant current power supply 28 by way of a first and second elongate connection means 30 and 32 respectively.

EXAMPLE II

Figure 20A:
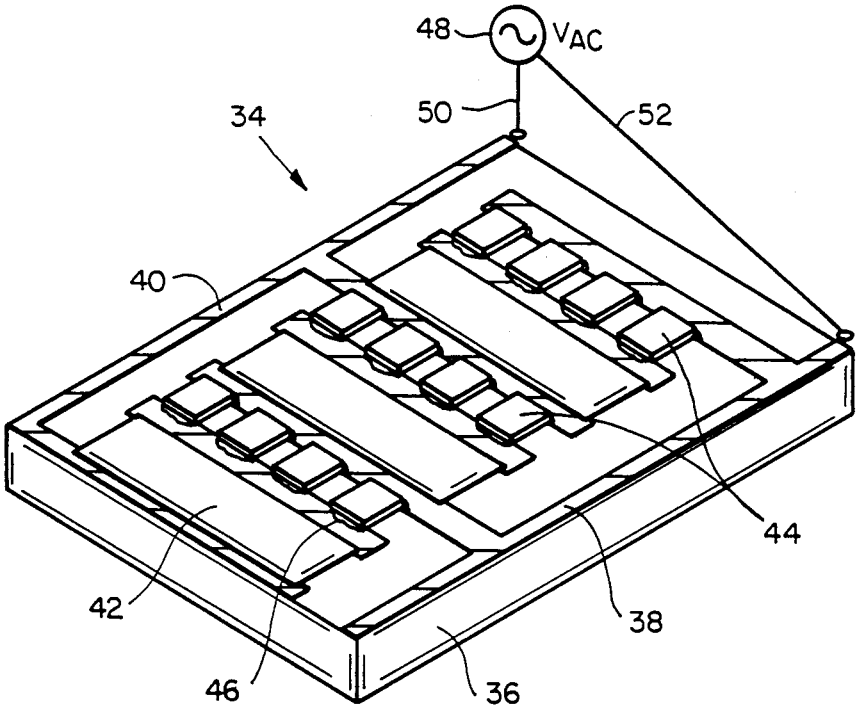
Figure 20B:
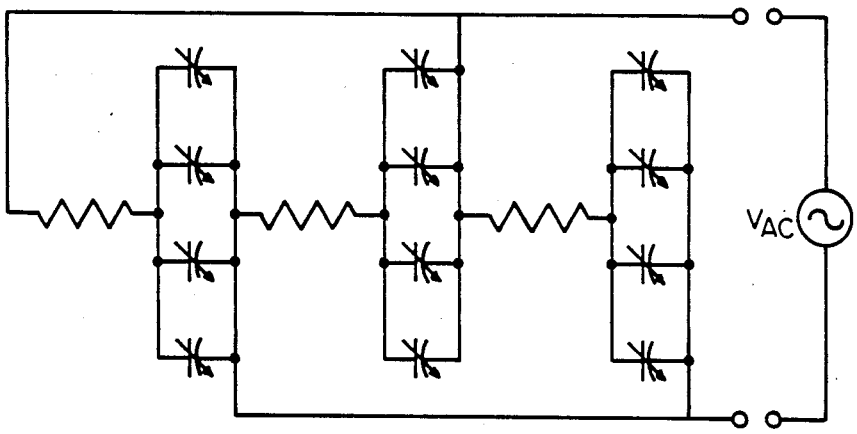

A self-regulating heater 34 as illustrated in FIG. 20A and as shown as an R-C electrical circuit in FIG. 20B, was produced in the following manner. A substrate 36 that comprised aluminum oxide was provided. The substrate 36 had dimensions 5.72 cm length, 5.08 cm width and 0.063 cm thickness. Silver palladium cermet based thick film conductors 38 and 40 were processed onto the substrate 36 at a processing temperature of 850° C. Such a thick film material is available from ESL Corporation, King of Prussia, Pa., product number 9623B. This step was followed by processing onto the substrate three ruthenium oxide based thick film resistors 42 at a processing temperature of 850° C. Each resistor 42 had a resistance of 339 ohms. Suitable resistors comprise a blend of ESL thick film resistors, product Nos. 2913 and 2914 at a 47/53% ratio. Next, twelve capacitors 44 were mounted on the substrate 36, using 60/40 lead tin solder 46. Each of the twelve capacitors 44 were Z5U type barium titinate 0.47 microfarad capacitors. Such capacitors are available from Sprague Corporation, North Adam, Mass., product number 2CZ5U474M100A. The heater 34 was connected to a 115 V (rms) 0.4 Khz constant voltage power supply 48 by way of conductors 50 and 52.

EXAMPLE III

Figure 21:
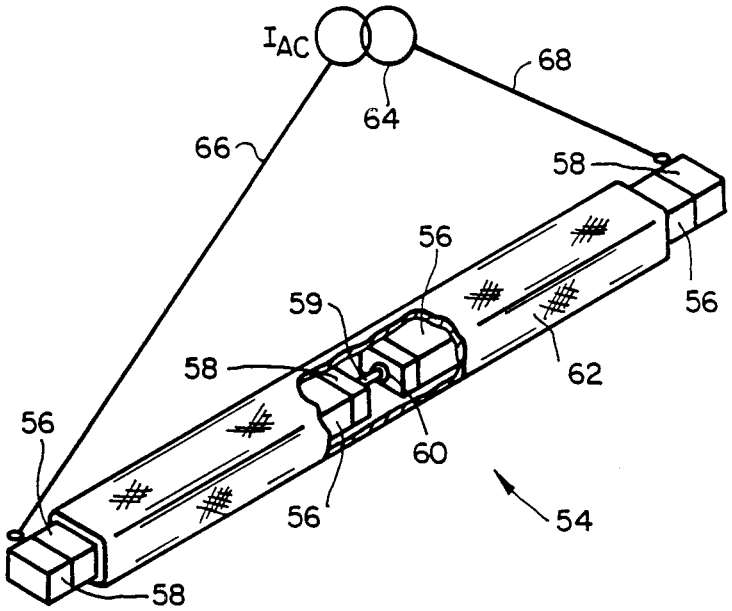

An elongate self-regulating heater 54 as illustrated in FIG. 21 was constructed in the following way. A plurality of siliconcarbide ceramic resistive heating components 56 with metalized ends 58 was provided. Each of the heating components 56 had a substantially negative temperature coefficient of resistance. Each of the heating components 56 had a length of 12.7 cm, a square cross-section 0.254 ×0.254 cm and a resistance of 77 ohm. The components 56 are available from Norton, Inc., Worcester, Mass. The components 56 were connected using a 14 AWG copper wire 59 and mechanical clamps 60. The connected components were insulated with a glass braid 62. The heater 54 was connected to a 0.23 amp (rms) 60 hz constant current source 64 by way of connection means 66 and 68.

EXAMPLE IV

Figure 22:
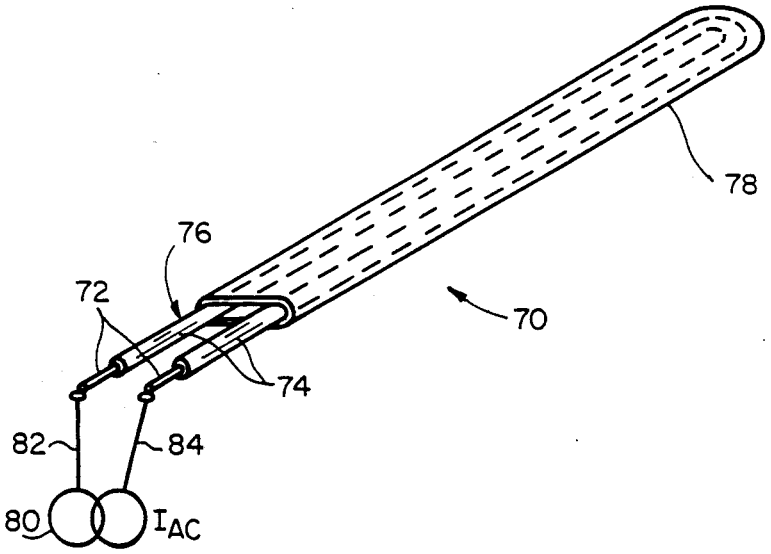

An elongate heater 70 as illustrated in FIG. 22 was constructed in the following way. A resistive heating component 72 having a substantially zero temperature coefficient of resistance was provided. The component 72 had a length of 3.66 meters, an outer diameter of 0.165 cm and a resistance of 0.035 ohm/cm. A suitable component 72 is sold by California Fine Wire, Grover City, Calif. under the product number Stable Ohm 675. Thus component 72 was insulated by Viton heat-shrink insulating material 74, of the type available through Raychem Corporation, Menlo Park, Calif., to produce an insulated component 76. The insulated component 76 was folded back on itself, in half, and further insulated with an outer jacket 78 of Viton heat-shrink insulating material. The heater 70 was connected to a 6 amp(rms) constant current power supply 80 by way of connection means 82 and 84. The heater 70 provided a constant-voltage cut-to-length series heater, producing 39 watts per meter.

What is claimed:

1. An electrical heater which comprises (A) two connection means which are connectable to an AC power supply; and (B) a plurality of discrete, spaced-apart, heating units, each of said heater units comprising (a) a reactive component;

(b) a resistive heating component which generates heat when the connection means are connected to a suitable AC power supply; and (c) a temperature responsive component which has a property which varies with temperature so that, when the heater is connected to a suitable AC power supply, the heat generated by the heating unit decreases substantially as the temperature of the unit approaches an elevated temperature;

said reactive component, when it is an inductor and is the same as the temperature-responsive component, being connected to the connection means by discrete electrical conductors.

2. A heater according to claim 1 wherein the temperature-sensitive component is not in direct physical contact with the heating component.

3. A heater according to claim 1 which is suitable for connection to a constant voltage AC power supply, wherein the heating components are connected in parallel with each other between the connection means, and wherein, in each heating unit, the temperature-responsive component and the reactive component together form a combination which exhibits PTCZ behavior and which is connected in series with the heating component.

4. A heater according to claim 3 wherein the reactive component and the temperature-responsive component are combined in the form of a capacitor comprising a dielectric whose dielectric constant decreases with temperature.

5. A heater according to claim 4 wherein the capacitor has a dielectric whose dielectric constant at a first temperature $T_1$, $T_1$ being at least 0° C., is at least 3 times the dielectric constant of the dielectric at a second temperature $T_2$ which is between $T_1$ and $(T_1+100)$°C.

6. A heater according to claim 5 wherein the dielectric is a ferroelectric ceramic having a Curie point of at least 40° C.

7. A heater according to claim 4 wherein each of the heating units comprises an insulating base having a ZTCR resistor and a PTCZ capacitor secured thereto.

8. A heater according to claim 1 which is suitable for connection to a constant voltage AC power supply, wherein the heating components are connected in parallel with each other between the connection means, and wherein, in each heating unit, the temperature-responsive component and the reactive component together form a combination which exhibits NTCZ behavior and which is connected in parallel with the heating component.

9. A heater according to claim 8 wherein the reactive component and the temperature-responsive component are combined in the form of an inductor having a core whose permeability at a first temperature $T_1$, $T_1$ being at least 0° C., is at least 3 times the permeability of the core at a second temperature $T_2$ which is between $T_1$ and $(T_1+100)$°C.

10. A heater according to claim 8 wherein the reactive component and the temperature-responsive component are combined in the form of an inductor comprising a ferromagnetic ceramic having a Curie point of at least 40° C.

11. A heater according to claim 1 which is suitable for connection to a constant current AC power supply, wherein the heating components are connected in series with each other, and wherein, in each heating unit, the temperature-responsive component and the reactive component together form a combination which exhibits NTCZ behavior and which is connected in parallel with the heating component by means of discrete electrical conductors.

12. A heater according to claim 11 wherein the reactive and temperature-sensitive components are combined in the form of an inductor having a core whose permeability at a first temperature $T_1$, $T_1$ being at least 0° C., is at least 3 times the permeability of the core at a second temperature $T_2$ which is between $T_1$ and $(T_1+100)$°C.

13. A heater according to claim 12 wherein the reactive and temperature-sensitive components are provided by a ZTCR conductor and a core composed of a material having a Curie point of at least 100° C., and the resistive component is in the form of a resistive metal wire.

14. A heater according to claim 1 wherein the temperature-responsive component is a frequency-changing component which, when the heater is connected to a suitable AC power source, changes the frequency of the current passing through the reactive component in response to changes in temperature.

15. A heater according to claim 1 wherein the reactive component has both capacitance and inductance, at least one of the capacitance and the inductance varying with temperature so that the heating unit has a temperature-dependent resonant or anti-resonant frequency.

16. A heater according to claim 1 wherein the heating component comprises first and second resistors connected in parallel.

17. A heater according to claim 1 wherein the heating component is connected in series with the reactive component, and the reactive component comprises first and second reactive elements which are of opposite sign and are connected in parallel.

18. A heater according to claim 1 which comprises reactive components between adjacent heater units.

19. A heating circuit which consists essentially of
(A) an AC power supply, and
(B) a heating unit which comprises
(a) a reactive component;
(b) a resistive heating component which is connected to the reactive component by discrete electrical conductors; and
(c) a temperature-responsive component which is not in direct physical contact with the heating component and which has an electrical property which varies with temperature so that the heat generated by the heating unit decreases substantially as the temperature of the unit approaches an elevated temperature.

20. A self-regulating electrical heater which
(A) two connection means which are connectable to a power supply; and
(B) a plurality of discrete, spaced-apart heating units, each of said heater units comprising
(a) an active circuit component;
(b) a resistive heating component which generates heat when the connection means are connected to a suitable power supply; and
(c) a temperature-responsive component which has an electrical property which varies with temperature so that, when the heater is connected to a suitable power supply, the heat generated by the heating unit decreases substantially as the temperature of the unit approaches an elevated temperature.

21. An electrical heater comprising:
(A) two elongate connection means which are connectable to the constant voltage power supply; and
(B) a plurality of discrete, spaced-apart heating units which are electrically connected in parallel with each other between the connection means and each of which comprises:
(a) a first resistive heating component having a positive temperature coefficient of resistance; and
(b) a second resistive heating component having a zero temperature coefficient of resistance and connected in parallel with the first resistive heating component.

22. A heating circuit which comprises
(A) a constant current AC power supply, and
(B) a heating unit which comprises
(a) an NTC inductive component; and
(b) a resistive heating component which is connected in parallel with the reactive component by discrete electrical conductors;
whereby the heat generated by the heating unit decreases substantially as the temperature of the unit approaches an elevated temperature.

23. A method of heating liquid which comprises placing the liquid in thermal contact with a heating unit which is connected to an AC power supply and which comprises
(a) a reactive component;
(b) a resistive heating component which is connected to the reactive component by discrete electrical conductors; and
(c) a temperature-responsive component which is not in direct physical contact with the heating component and which has an electrical property which varies with temperature so that the heat generated by the heating unit decreases substantially as the temperature of the unit approaches an elevated temperature.

* * * * *

UNITED STATES PATENT AND TRADEMARK OFFICE

CERTIFICATE OF CORRECTION

PATENT NO. : 4,849,611

DATED : July 18, 1989

INVENTOR(S) : Wells Whitney et al

It is certified that error appears in the above-identified patent and that said Letters Patent is hereby corrected as shown below:

Title page, in the Inventors section, after "all of Calif." insert --; Edward B. Atkinson, Ipswich, Suffolk, England.--.

Column 8, line 67, replace "su group" by --subgroup--.

Column 9, line 15, replace "e" by --be--.

Figure 6:
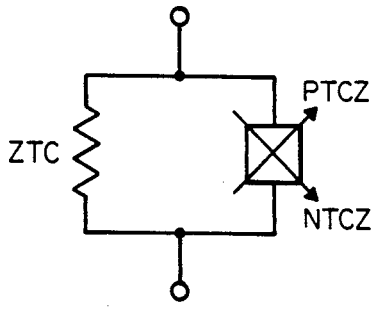

Column 10, line 55, replace "FIG. 7" by --FIG 6--.

Column 13, line 34, replace "cam" by --can--.

Column 13, line 66, replace "ar" by --are--.

Column 18, line 3, after "which" insert --comprises--.

Signed and Sealed this

Fourth Day of June, 1991

*Attest:*

HARRY F. MANBECK, JR.

*Attesting Officer*

*Commissioner of Patents and Trademarks*